United States Patent [19]

Nelson

[11] 4,065,216

[45] Dec. 27, 1977

[54] ADJUSTABLE FAUCET HANDLE ASSEMBLY

[75] Inventor: Merritt J. Nelson, Sparta, Mich.

[73] Assignee: Zin-Plas Corporation, Grand Rapids, Mich.

[21] Appl. No.: 725,085

[22] Filed: Sept. 17, 1976

[51] Int. Cl.[2] ..... F16B 1/00

[52] U.S. Cl. ..... 403/4; 16/121; 74/548; 403/359

[58] Field of Search ..... 403/3, 4, 258, 365, 403/359; 16/117, 118, 121, DIG. 24; 74/548, 553

[56] References Cited

U.S. PATENT DOCUMENTS

| | | | |
|---|---|---|---|
| 1,575,410 | 3/1926 | Bradley | 74/553 X |
| 1,735,604 | 11/1929 | Delany | 16/118 X |
| 2,592,256 | 4/1952 | Du Charme | 137/315 |
| 3,047,700 | 7/1962 | Bailey | 403/354 X |
| 3,250,148 | 5/1966 | Soles | 74/548 |
| 3,301,580 | 1/1967 | Greitzer | 403/23 |
| 3,396,604 | 8/1968 | Samuels | 16/121 X |
| 3,557,637 | 1/1971 | Tomczak | 74/553 |

*Primary Examiner*—Andrew V. Kundrat
*Attorney, Agent, or Firm*—McGarry & Waters

[57] ABSTRACT

A faucet handle assembly has a skirt attached to an insert which is in turn secured to a faucet stem. The skirt has a plurality of ribs each of which has a shoulder portion positioned so the top part of the rib extends over the lower part of the rib. The insert has two sets of different size notches. Each set of notches can be aligned in registry with the ribs. The shoulder portion of the rib engages the top surface of the flange adjacent the edge of one size notches. Another size notches are sufficiently large to fit the top part of the ribs within the notches. When the large notches engage the plurality of ribs, the top section of the skirt is supported by the flange abutting thereto. The skirt height can be adjusted through a choice of notches which engage the plurality of ribs.

8 Claims, 12 Drawing Figures

ADJUSTABLE FAUCET HANDLE ASSEMBLY

BACKGROUND OF THE INVENTION

1. Field of the Invention

This invention relates to faucet handle assemblies and more particularly, to faucet handle assemblies that have an adjustable skirt.

2. Statement of the Prior Art

Handle assemblies have long been styled so that the handle has a skirt which hides the faucet stem. The handle has been conventionally secured to an insert which in turn is secured to the top of the faucet stem. These handles wear out and need to be replaced from time to time.

One replaceable handle is disclosed in U.S. Pat. No. 3,791,402 issued to Shuler on Feb. 12, 1974. The Shuler device discloses a handle which attaches to a stem and to a locking insert. The locking insert in turn is secured to the stem. The insert has three bosses having threaded apertures therethrough wherein laterally extending screws engage the threaded apertures and abut the stem so that the insert is securely mounted onto the stem.

The trade has developed with two sizes of stems. Thus any replacement handle assembly had to include two handles and two mounting screws for any replacement faucet in order to make certain that the replacement handle would have the proper skirt length.

Previous attempts have been made to eliminate the need for two differently sized handles wherein the skirt styled handle can be adjustably attached to the stem portion.

One such adjustable handle is disclosed in U.S. Pat. No. 3,250,148 issued to Soles on May 10, 1966. The Soles reference discloses a skirt styled handle having an internally threaded axial bore. An insert member is threaded in the bore and has a centrally splined aperture which fits over the splined stem. A threaded fastener is threaded into an axial aperture of the stem and secures the insert member and skirt styled handles onto the stem.

Another adjustable handle is disclosed in U.S. Pat. No. 3,396,604 issued to Samuels et al on Aug. 13, 1968. The Samuels et al reference discloses an adjustable handle assembly which has a holder section attached to the stem. The holder member fits within an insert member which in turn is secured to the handle body. The holder is secured onto the stem by a laterally extending locking screw. The insert member is placed over the holding member to a desired position. At this position, the threaded screws and tapered head can be tightened downwardly so that end segments of the holder will be pushed outwardly and the toothed edge of the segment will engage teeth of the insert. The handle body is secured over the insert by a retaining screw. The handle body was vertically extending teeth along the inside of its tapered surface. The insert has teeth which engage the handle's teeth to prevent relative rotation of the handle holder with respect to the insert.

SUMMARY OF THE INVENTION

According to the invention, a faucet handle assembly has a skirt portion having a hollow interior, open bottom, and a horizontal top section. An insert fits within the skirt portion hollow securing means. The handle is supported on the insert by means of a shoulder fixed to the handle or insert so that the handle has an adjustably fixed height relative to the insert.

Preferably the insert and the skirt handle engage one another by means of interlocking rib portions which extend in a longitudinal fashion so as to prevent the insert and handle from rotating with respect to each other.

Preferably the ribs are formed in the sides of the hollow interior of the skirt handle. Desirably, a shoulder portion extends horizontally from each rib so that the upper portion of the rib above the shoulder extends over the lower portion of the rib. Preferably, the shoulder is in the same transverse plane as corresponding shoulders on other ribs so as to form a set of coplanar extending shoulders.

In one embodiment, the insert has a top flange engaging the plurality of ribs. The flange has at least two sets of notches wherein each set has its notches in the same spatial relationship as the ribs so as to allow the insert to engage the rib through the desired set of notches.

In one specific embodiment, when the top flange engages the ribs through the set of smaller notches, the shoulder of the ribs engages the top surface of the flange so that the skirt handle is supported by the flange at the shoulder. The shoulder extends inwardly toward the central axis of the skirt handle and engages the flange adjacent to the inner edge of the smaller notches.

In another embodiment, the lip portion extends circumferentially over the lower portion of the rib so that the lip portion engages the flange adjacent the side edges of the smaller notches.

Preferably a second set of notches are of sufficient size to have the shoulder fit within said notches so that the shoulder portion can pass through the notches. The flange supports the skirt handle at a higher point along the rib. When the set of largest notches are aligned with the plurality of ribs, the flange abuts the top section of the skirt handle.

In one embodiment, four ribs are longitudinally placed on the sides of the hollow interior with each rib being placed at right angles with respect to an adjacent rib. Each set of notches has each notch set at right angles with an adjacent notch of the set with respect to the central point of the flange. A second set of four notches are also set at right angles to each other and are offset at a 45° angle to the first set of notches.

Preferably the insert is fastened to the stem by three laterally extending screws which are threaded through a retaining side section of the insert. The screw has its threaded end abutting a stem so as to secure the stem within the retaining side walls of the insert.

Preferably the skirt has an aperture through its top section which is aligned with an aperture extending through the center of the flange of the insert. These two apertures are aligned with an axial threaded aperture in the stem. A threaded fastener extends through the two apertures and engages the threaded aperture of the stem to secure the skirt onto the stem and mounted insert. Desirably, a decorative cap is placed over the top section of the handle to conceal the threaded fastener.

The invention provides for an aesthetically pleasing handle which can be mounted onto concealed faucet stems of either of two standard heights. The skirt handle section can be placed in a variety of heights relative to the insert by the proper positioning of the skirt with relation to the insert. In this fashion, the skirt can be placed on a taller stem so that a maximum amount of stem can be concealed or on a shorter stem so that the skirt can be placed high enough so as to avoid contact with the stem base. The invention also provides for an adjustable handle that can be fixed rotationally relative to the insert and also conceal the mounting means for mounting the handle assembly onto the stem.

BRIEF DESCRIPTION OF THE DRAWINGS

The invention will now be described with reference to the accompanying drawings in which.

DETAILED DESCRIPTION OF THE PREFERRED EMBODIMENTS

Figure 1:
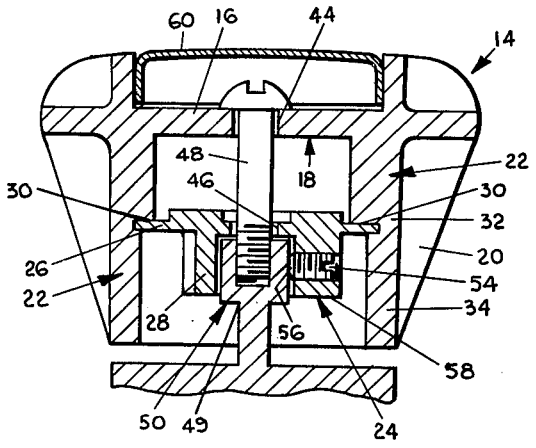
FIG. 1 is a side elevational view in section of a handle assembly illustrating one embodiment of the invention.

Referring to FIG. 1, a skirt handle 14 has a top section 16 and a hollow interior 18. The hollow interior is surrounded by the skirt 20 of handle 14. At the sides of the hollow interior 18 are ribs 22. An insert 24 is positioned within the hollow interior 18. The insert has a top flange 26 and a retaining boss section 28. The insert 24 has its top flange 26 engage ribs 22.

Figure 2:
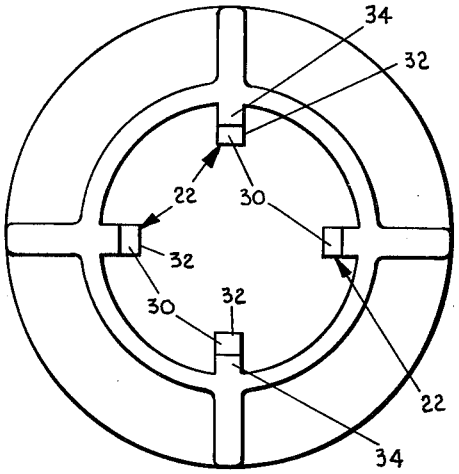
FIG. 2 is a bottom plan view of the skirt handle shown in FIG. 1.

As shown in FIG. 2, the skirt handle 14 has an open ended bottom. Extending from the sides of the hollow interior 18 are four ribs 22. Each rib has at its midsection an extending shoulder 30 as that the upper section 32 of ribs 22 extend over the lower section 34 toward the central axis of the skirt handle 14. Each rib is set at 90° from each other relative to the central axis of the skirt handle 14.

Figure 3:
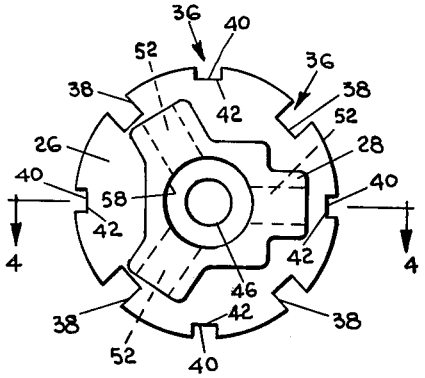
FIG. 3 is a bottom plan view of the insert shown in the embodiment in FIG. 1.

As shown in FIG. 3, the insert has its top flange 26 extending over the boss section 28. At the outer edges of the top flange 26 are a plurality of notches 36. Each notch 36 has the same width as ribs 22. Four notches 38 have a depth of at least the thickness of the upper portion 32 of ribs 22. Each of the deep notches is set at right angles with respect to each other from the center of the flange. Four other shallower notches 40 have a depth less than the thickness of the upper portion 32 of ribs 22 but greater than the thickness of the lower portion 34 of ribs 22.

Referring to FIG. 1, when the shallow notches 40 engage ribs 22, the extending shoulder 30 on ribs 22 engages the top surface of the flange 26 adjacent the inner edge 42 of the shallow notches 40.

Aperture 44 extends through the top section 16 of skirt handle 14 and is aligned with an aperture 46 through flange 26. A threaded fastener 48 extends through apertures 44 and 46 to threadably engage an axial threaded bore 49 in faucet stem 50.

Figure 4:
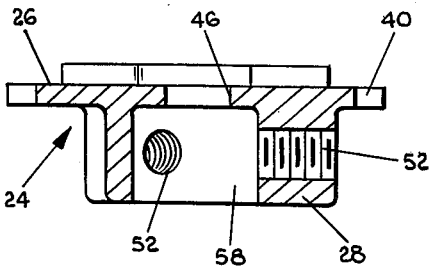
FIG. 4 is a cross-sectional view of the insert seen along lines 4—4 of FIG. 3.

Referring to FIG. 4, the insert 24 has a boss section 28 through which extend laterally three threaded apertures 52. As shown in FIG. 1, a threaded set screw 54 threadably engages apertures 52 so that the threaded ends 56 of set screw 54 securely abuts stem 50 within a hollow retaining portion 58 in boss 28.

Figure 5:
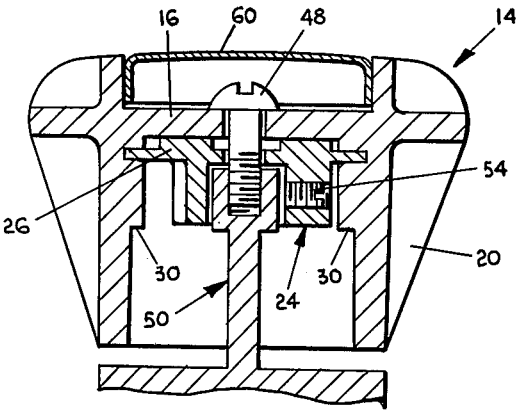
FIG. 5 is a side elevational view in section of the skirt handle mounted on the stem in a second position.

Referring to FIGS. 3 and 5, when skirt handle 14 is rotated 45° with respect to insert 24, the ribs 22 engage the deeper set of notches 38. When the deeper set of notches 38 are engaged with ribs 22, the extending shoulder 30 does not abut the top surface of the flange 26. The skirt handle 14 is free to slide downwardly until the top flange 26 abuts the top horizontal section 16 of skirt handle 14.

A cap 60 is secured over the top section 16 to conceal threaded fastener 48. Skirt 20 conceals insert 24, the set screws 54 and a desirable amount of stem 50. The invention provides for an aesthetically pleasing faucet handle which can be adjustable to compensate for stems 50 of different heights.

Figure 6:
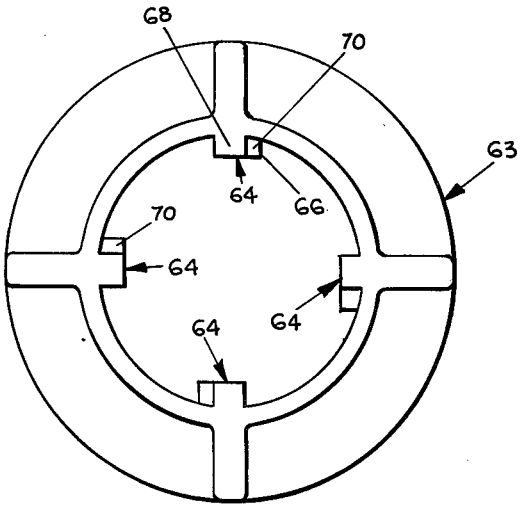
FIG. 6 is a bottom plan view of a second embodiment of the skirt handle.
Figure 7:
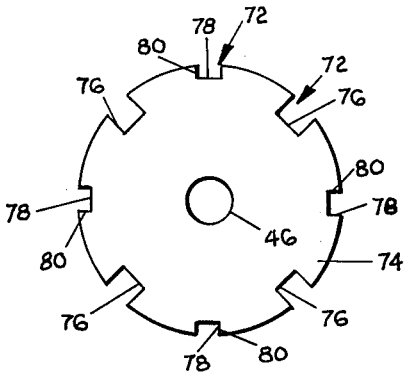
FIG. 7 is a top plan view of a second embodiment of the insert.

Referring to FIGS. 6 and 7, a second embodiment of the invention is disclosed. As shown in FIG. 6, a skirt handle 63 has ribs 64 having the top portion 66 with the same thickness but with a different width than a bottom portion 68. The top portion 66 extends over the bottom portion 68 and to the side so that shoulder 70 is to the side of the bottom portion 68. As shown in FIG. 7, the notches 72 in flange 74 have the same depth but have different lengths. One set of notches 76 has a length sufficiently long to fit the upper section 66 of ribs 64. The narrower notches 78 have a length greater than the width of the bottom section 68 of ribs 64 but less than the width of the upper section 66. When notches 78 engage ribs 64, the extending shoulder 70 engages the top surface of flange 74 adjacent to the side edge 80 and notch 78.

Figure 8:
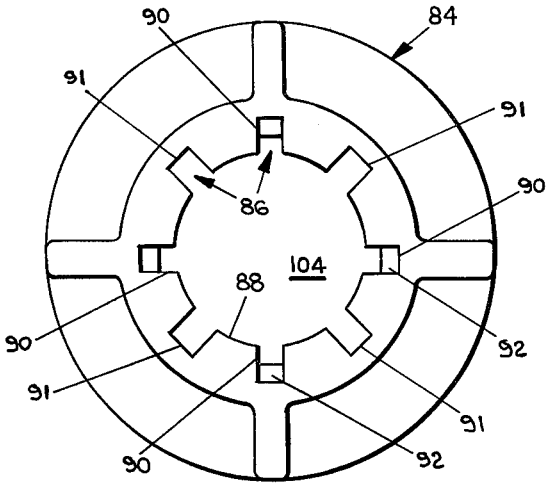
FIG. 8 is a bottom plan view of a third embodiment of the handle.
Figure 9:
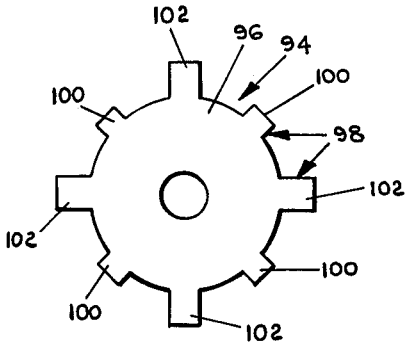
FIG. 9 is a top plan view of a third embodiment of the insert.

Referring to FIGS. 8 and 9, another embodiment of the invention is disclosed. As shown in FIG. 8, the skirt handle 84 has a plurality of notches 86 extending longitudinally along the hollow interior 88. Of the eight notches 86, four of the notches 90 have a shoulder 92 extending partly over the notches 90. As shown in FIG. 9, the insert 94 has a top flange 96 that has a plurality of tabs 98 extending outwardly from the perimeter of flange 96. Of tabs 98, four of the tabs 100 have a length equal to the depth of notches 90 at a point where shoulders 92 extend outwardly from notches 90. Longer tabs 102 have a length equal to the depth of notches 91 that have no shoulder. The two sets of tabs 100 and 102 are offset from each other by a 45° angle.

When tabs 102 engage notches 90, shoulder 92 abuts the surface of tabs 102 and supports the skirt handle 84 at a position where shoulder 92 is located.

When longer tabs 102 engage notches 91, and shallow tabs 100 engage notches 90, the insert is free to pass by shoulders 92 so that the flange 96 abuts the top section 104 of skirt handle 84.

Figure 10:
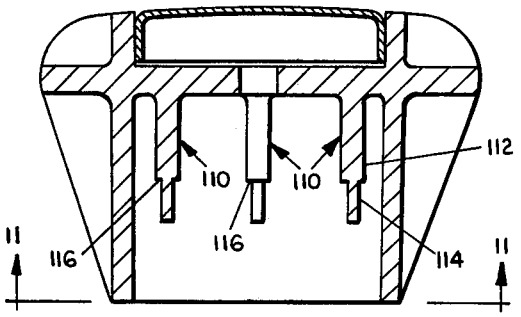
FIG. 10 is a cross-sectional view of a fourth embodiment of the skirt handle.
Figure 11:
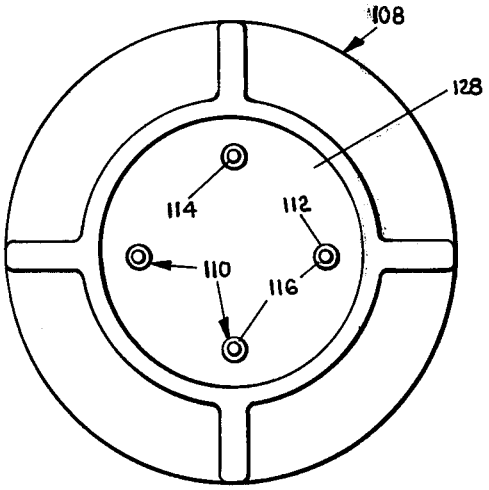
FIG. 11 is a bottom plan view taken along lines 11—11 as shown in FIG. 10.
Figure 12:
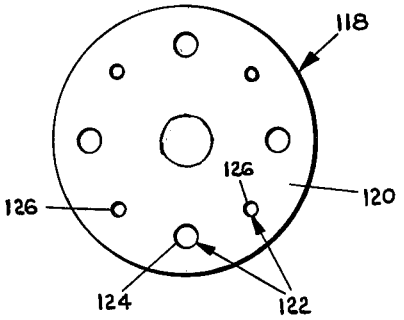
FIG. 12 is a top plan view of a fourth embodiment of the insert.

Referring to FIGS. 10, 11 and 12, a different embodiment of the invention is disclosed. As shown in FIG. 10, the skirt handle 108 has a plurality of longitudinally extending prongs 110. The prongs have an upper portion 112 and a narrower lower portion 114. Between the lower and upper portions are extending shoulders 116. As shown in FIG. 11, the prongs are four in number and are circumferentially equidistant from the central axis of the skirt handle 108.

Referring to FIG. 12, the insert 118 has a top flange 120 having a plurality of apertures 122 therethrough. The larger apertures 124 have the same size and shape as the upper portion of prongs 110. The smaller apertures 126 have the same size and shape as the lower portion 114 of prongs 110. The apertures 124 and 126 have the same spatial arrangement as prongs 110 so that they may engage the prongs 110. When the smaller apertures 126 engage prongs 110, the lower portion 114 extends therethrough and shoulder 116 abuts the top surface of flange 120 adjacent the edges of the smaller apertures 126. The skirt handle 108 is supported at the position where the shoulder 116 engages the flange 120. When larger apertures 124 engage prongs 110, the lower portion 114 and upper portion 112 pass therethrough so that flange 120 abuts top section of skirt handle 108.

The embodiments shown in FIGS. 6 through 12 function in a manner similar to that shown in the embodiment disclosed in FIGS. 1 through 5 a handle which can be adjustably mounted onto a stem and capable of concealing the insert, set screws, threaded fastener and a desired portion of the faucet stem. The embodiments provide for a handle which is securely mounted onto the stem and free from rotation relative to the insert and the stem.

It should be understood that the foregoing embodiments of the invention are merely illustrative to the preferred practice of the invention and that various changes and modifications may be made in the arrangements and details of construction of the embodiments described herein without departing from the spirit and scope of the invention.

The embodiment of the invention in which an exclusive property or privilege is claimed are defined as follows:

1. A faucet handle assembly comprising:
   a skirt on the handle having a hollow interior and retaining sides;
   an insert; and
   two sets of alterate interengaging means on the skirt and insert each of the sets having means for preventing relative rotation in clockwise and counterclockwise directions between the skirt and insert, said interengaging means being so shaped as to provide one axial position of the insert within the skirt when one interengaging means is operative and providing a second axial position of the insert when the second interengaging means is operative.

2. A faucet handle assembly as described in claim 1 further comprising:
   the skirt having a hollow interior, open bottom, retainer sides and a top section;
   fastening means for rigidly fastening the insert onto a faucet stem; and wherein
   the interengaging means have a shoulder section on one of the skirt and insert and engaging the other of the skirt and insert at the shoulder portion for supporting the skirt in a plurality of axial positions determined by the position of the shoulder section, the interengaging means having a longitudinal engaging section to secure the skirt from rotation with respect to the insert; and
   securing means for securing the skirt to the faucet stem.

3. A faucet assembly defined in claim 2 wherein the interengaging means comprises the insert and skirt having corresponding engaging ribs which secure the skirt and insert from relative rotation; the shoulder section extends from the ribs.

4. A faucet handle assembly as defined in claim 3 wherein the skirt has a plurality of longitudinal ribs extending along the side of the hollow interior, each rib has at least one shoulder section so that the rib portion above the shoulder extends over the lower portion below the shoulder and has a greater cross-sectional area than the lower portion, each shoulder is on the same transverse plane as the corresponding shoulder on the other ribs so as to form a set of extending shoulders; the insert has a top flange which engages the ribs of the skirt, the flange has a plurality of notches around its outer edge which engage the ribs; the notches include at least two sets of differently sized notches; each set of notches can align with the plurality ribs; a set of shoulders of the ribs can engage the flange surface adjacent the inner edge of the notches when a set of notches engage the ribs to support the skirt in a position set by the engagement of the shoulders with the notched edges, 5. A faucet handle assembly as defined in claim 4 wherein the skirt has a plurality of ribs, each rib has at least one shoulder so that a top part of the rib extends over the lower part toward the central axis of the skirt wherein each shoulder is on the same plane as the corresponding shoulders on the other ribs, the insert has a top flange having a plurality of notches of at least two different depths so that each set of notches has each notch positioned in the same spatial pattern as the ribs of the handle; a shoulder engages the flange surface adjacent the inner edge of the notches when a set of notches engage the ribs; a second set of notches has notches of sufficient depth so as to have the top part of the ribs fit within the second set of notches and support the skirt at a second point.

6. A faucet assembly as defined in claim 5 wherein the insert fits over the end of the faucet stem, the insert has a side retaining wall which surrounds the stem; the top flange of the insert has a set of four notches of equal depth positioned around the flange in a spatial relationship with respect to each other notch; a second set of notches having a different depth is formed around the flange in the same relationship as the first set of notches but offset by an angle so as to form eight distinct notches of two different depths surrounding the periphery of the flange; the ribs of the skirt number four wherein the four ribs have the same spatial pattern as each set of notches and can engage with each set of notches; the one set of notches has a depth so as to have the flange adjacent the inside edge of the notches engage the extending shoulder section of the ribs when the first set of notches engage the ribs; the second set of notches has notches of sufficient depth so as to have the top part of the ribs fit within the second set of notches and support the skirt at a second point where the flange abuts the top section of the skirt.

7. A faucet handle assembly as defined in claim 2 wherein the fastening means includes at least one laterally extending fastener threadably engaging a side wall of the insert and abutting the faucet stem so that the stem is fixedly wedged between the fastener and insert; the securing means includes a threaded fastener placed through the top of the skirt and flange of the insert and engaging a threaded central aperture of the stem.

8. A faucet handle as defined in claim 4 wherein the skirt has a plurality of ribs, each rib has at least one shoulder section so that the rib portion above the shoulder section has a greater width than the lower rib portion below the lip; the insert has a top flange having a plurality of notches of at least two different lengths along the perimeter of the flange so that each set of notches of the same length has the same spatial relationship as the plurality of ribs and can align thereto; the shoulder section of the ribs engages the flange surface adjacent the side edge of the notches when a set of notches engage the ribs; a second set of notches has notches of sufficient length so as to have the top part of the ribs fit within the second set of notches and support the skirt at a second point.

* * * * *